US007583905B2

(12) United States Patent
Kamisuwa

(10) Patent No.: US 7,583,905 B2
(45) Date of Patent: Sep. 1, 2009

(54) IMAGE FORMING APPARATUS AND IMAGE FORMING METHOD

(75) Inventor: Yoshikatsu Kamisuwa, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 220 days.

(21) Appl. No.: 11/779,368

(22) Filed: Jul. 18, 2007

(65) Prior Publication Data

US 2008/0019707 A1 Jan. 24, 2008

(30) Foreign Application Priority Data

Jul. 19, 2006 (JP) ..... 2006-197328

(51) Int. Cl.
*G03G 15/00* (2006.01)

(52) U.S. Cl. ..... 399/2; 399/110

(58) Field of Classification Search ..... 399/1, 399/2, 107, 110, 297, 298, 301, 306, 308, 399/309

See application file for complete search history.

(56) References Cited

U.S. PATENT DOCUMENTS 6,556,804 B1 * 4/2003 Lobel et al. ..... 399/306
6,650,864 B2 * 11/2003 Miyamoto et al. ..... 399/384
7,206,536 B2 * 4/2007 Julien ..... 399/110

FOREIGN PATENT DOCUMENTS

JP 05-22232 3/1993
JP 08248648 9/1996

OTHER PUBLICATIONS

Chinese Office Action dated Apr. 17, 2009, corresponding to U.S. Appl. No. 11/779,368 filed on Jul. 18, 2007.

* cited by examiner

*Primary Examiner*—Hoan H Tran
(74) *Attorney, Agent, or Firm*—Turocy & Watson, LLP

(57) ABSTRACT

An image forming apparatus is installed in a digital multi-function peripheral (MFP) having a copying function of recording images continuously and a function of transmitting and receiving information to and from an external apparatus. The image forming apparatus includes a first storing section which stores recording media before recording, a plurality of image forming sections which form images and record the images on the recording media, and a second storing section which stores the recording media after recording. The image forming sections are configured to selectively perform an operation of recording images on the recording media by individually performing an image forming operation in parallel, and an operation of recording images on one recording medium by performing the image forming operation by turns.

20 Claims, 4 Drawing Sheets

| Case | Structure of image forming sections | | Effect | |
|---|---|---|---|---|
| | First module | Second module | Parallel operation | Series operation |
| 1 | Electrophotographic Color module | Electrophotographic Color module | Increase in speed | High-speed double-sided printing |
| 2 | Electrophotographic Color module | Electrophotographic Monochrome module | Reduction in cost | – |
| 3 | Electrophotographic Monochrome module | Electrophotographic Monochrome module | Increase in speed | High-speed double-sided printing |
| 4 | Electrophotographic Monochrome module | Inkjet color module | – | Printing with high image quality<br>Reduction in cost |
| 5 | Inkjet color module | Inkjet color module | Increase in speed | High-speed double-sided printing |

FIG. 5

IMAGE FORMING APPARATUS AND IMAGE FORMING METHOD

CROSS-REFERENCE TO RELATED APPLICATIONS

This application is based upon and claims the benefit of priority from prior Japanese Patent Application No. 2006-197328, filed Jul. 19, 2006, the entire contents of which are incorporated herein by reference.

BACKGROUND OF THE INVENTION

1. Field of the Invention

The present invention relates to an image forming apparatus having a plurality of image forming sections, in particular, an image forming apparatus in which a plurality of image forming sections are detachably formed, and an image forming method used for the same.

2. Description of the Related Art

In prior art, electrophotography and inkjet printing are known as main image forming systems used for image forming apparatuses.

In image forming apparatuses using electrophotography, an electrostatic latent image is formed by irradiating a charged photosensitive drum with laser light corresponding to an image signal, and an image formed on the photosensitive drum is printed on paper by processes such as development, transfer, and stripping.

In image forming apparatuses using inkjet printing, an image signal is resolved to obtain intensity of each color, ink is discharged from nozzles in accordance with the respective intensities of the colors, and an image is printed on printing paper.

When these image forming systems are compared with each other, they have respective advantages and drawbacks.

For example, electrophotography is generally expensive, although it achieves printing at higher speed than that of inkjet printing. Inkjet printing generally has low printing speed, although it is more inexpensive than eletrophotography.

An image forming apparatus obtained by combining electrophotography and inkjet printing is disclosed (Jpn. Pat. Appln. KOKOKU Pub. No. 5-22232).

BRIEF SUMMARY OF THE INVENTION

An image forming apparatus according to a first aspect of the present invention is installed in a digital multifunction peripheral (MFP) having a copying function of recording images continuously and a function of transmitting and receiving information to and from an external apparatus, and comprises: a first storing section which stores recording media before recording; a plurality of image forming sections which form images and record the images on the recording media; and a second storing section which stores the recording media after recording, wherein the image forming sections are configured to selectively perform an operation of recording images on the recording media by individually performing an image forming operation in parallel, and an operation of recording images on one recording medium by performing the image forming operation by turns.

An image forming method according to a second aspect of the present invention is used for an image forming apparatus installed in a digital multifunction peripheral (MFP) having a copying function of recording images continuously and a function of transmitting and receiving information to and from an external apparatus, and comprises: storing recording media before recording; selectively controlling a plurality of image forming sections which form images and record the images on the recording media, and causing the image forming sections to perform an operation of recording images on the recording media by individually performing an image forming operation in parallel, and an operation of recording images on one recording medium by performing the image forming operation by turns; and storing the recording media after recording.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 5 is a diagram illustrating configuration examples obtained by combining image forming sections.

DETAILED DESCRIPTION OF THE INVENTION

An embodiment of the present invention is explained, in which the present invention is applied to a digital MFP (multifunction peripheral) having a copying function of printing images continuously and information transmitting/receiving function with external apparatuses.

Figure 1:
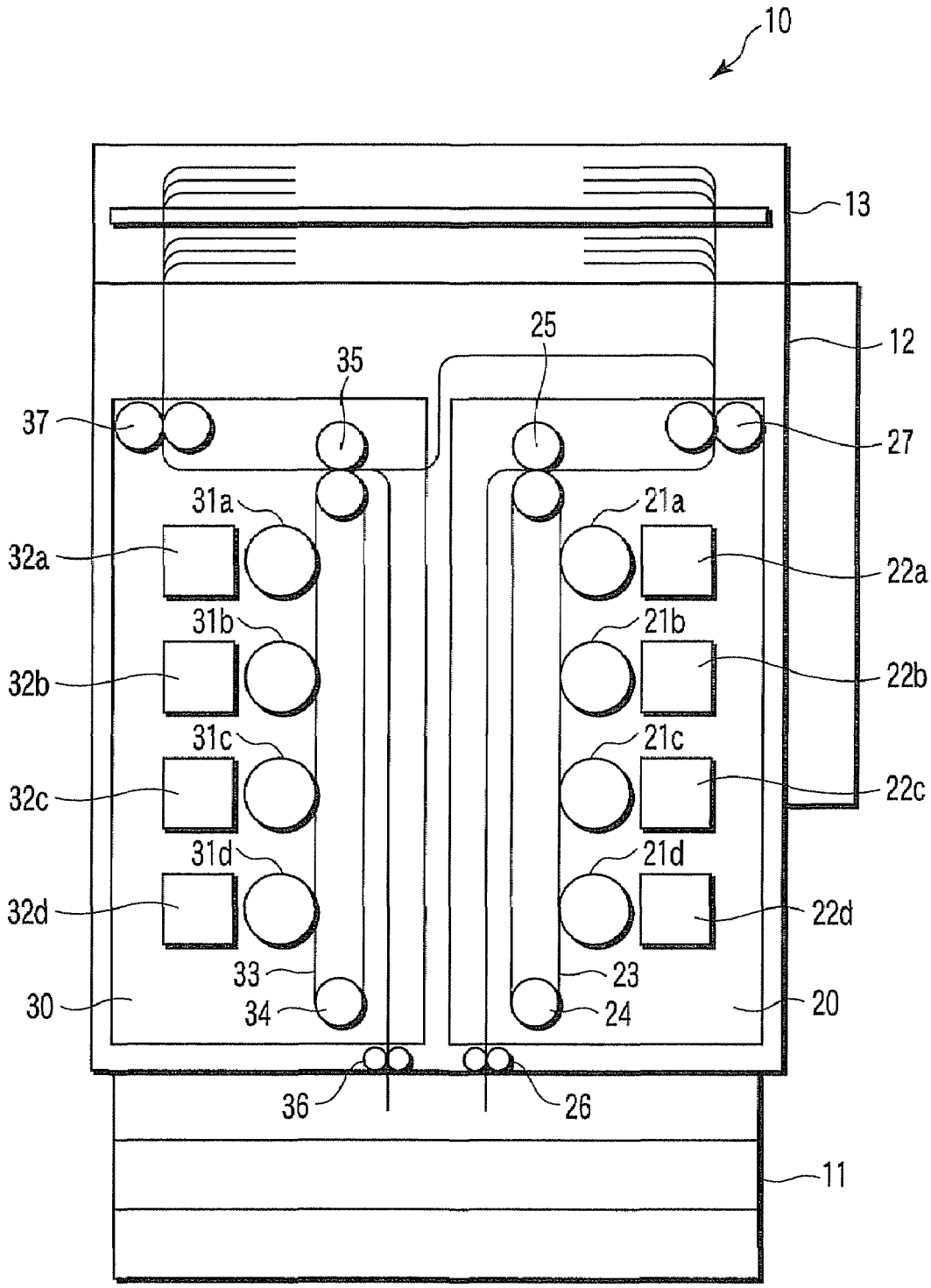
FIG. 1 is a diagram illustrating a configuration of an image forming apparatus according to a first embodiment of the present invention.

FIG. 1 is a diagram illustrating a configuration of an image forming apparatus according to a first embodiment of the present invention.

An image forming apparatus 10 comprises a paper feed unit 11, an image forming unit 12, and a paper delivery unit 13.

The paper feed unit 11 stores paper being recording media, and feeds the paper to the image forming unit 12. The image forming unit 12 forms images, and prints the images on the fed paper. The paper delivery unit 13 accumulates and stores the printed paper.

The image forming unit 12 has two image forming sections, that is, a first engine module 20 and a second engine module 30.

The first engine module 20 adopts quadruple tandem image forming system. The first engine module 20 is provided with photosensitive drums 21*a* to 21*d*, process units 22*a* to 22*d*, a transfer belt 23, a drive roller 24, a transfer roller 25, a paper feed roller 26, and a delivery roller 27.

Figure 2:
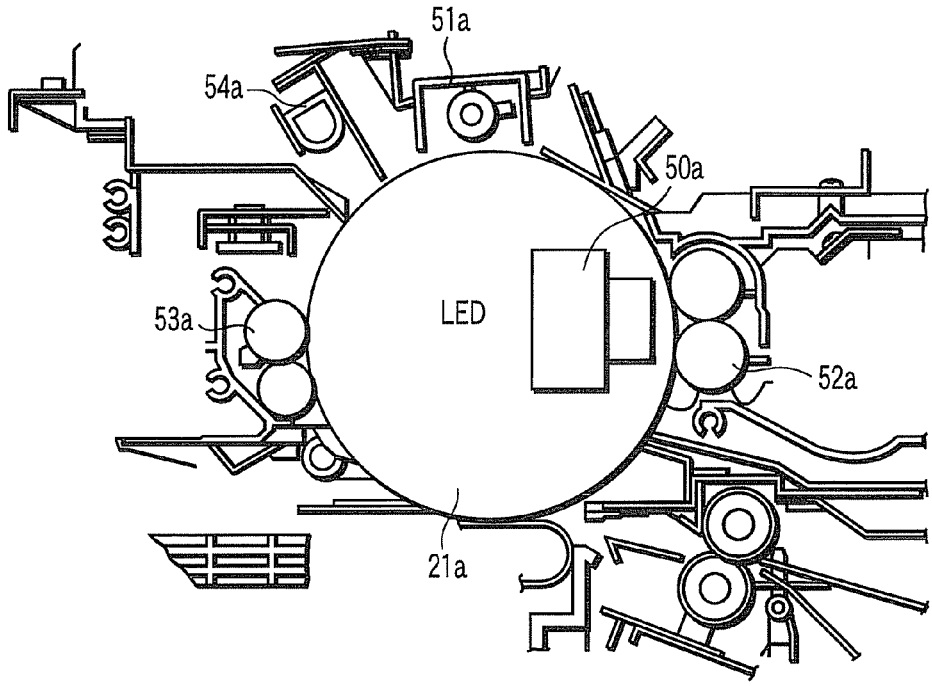
FIG. 2 is a diagram illustrating a placement of a photosensitive drum and a process unit.

FIG. 2 is a diagram illustrating a placement of the photosensitive drum 21*a* and the process unit 22*a*. The positional relationship between the photosensitive drums 21*b* to 21*d* and the respective process unit 22*b* and 22*d* is the same as this placement.

The photosensitive drum 21*a* is formed of a transparent glass tube, and a transparent conductive layer and a photosensitive layer are formed on the outer surface of the photosensitive drum. The photosensitive drum 21*a* rotates in a circumferential direction of the photosensitive drum 21. An LED array 50*a* which does not rotate is provided inside the photosensitive drum 21*a*.

Further, a charging device 51*a*, a developer device 52*a*, a cleaner 53*a*, and a static eliminating device 54*a* which are provided on the process unit 22*a* are arranged around the photosensitive drum 21*a*.

The charging device 51*a* uniformly charges the surface of the photosensitive drum 21*a*. The LED array 50*a* emits and turns out light in response to image signals. Specifically, the LED array 50 performs back exposure. The LED array 50 has a structure in which a plurality of light-emitting elements are arranged in a main-scanning direction (in the direction in which the rotation axis of the photosensitive drum 21*a* extends). Therefore, the LED array 50 does not need a scanning mechanism such as a polygon mirror.

Light emitted from the LED array 50*a* is applied onto the photosensitive drum 21*a*. When light is applied to the charged photosensitive drum 21*a*, the potential of portions of the drum to which the light has been applied lowers, and an electrostatic latent image is formed. The developer device 52*a* applies a developer to the photosensitive drum 21*a*, and thereby forms a toner image on the photosensitive drum 21*a*. The formed toner image is transferred to paper. After transfer, the cleaner 53*a* removes toner remaining on the photosensitive drum 21*a*. Thereafter, the static eliminating device 54*a* uniformly eliminates static electricity from the surface of the photosensitive drum 21*a*. Thereby, the photosensitive drum 21*a* returns to the initial state, and comes into a state of waiting for next image formation.

The second engine module 30 adopts a quadruple tandem image forming system. The second engine module 30 is provided with photosensitive drums 31*a* to 31*d*, process units 32*a* to 32*d*, a transfer belt 33, a drive roller 34, a transfer roller 35, a paper feed roller 36, and a delivery roller 37.

Operations of the photosensitive drums 31*a* to 31*d* and the process units 32*a* to 32*d* of the second engine module 30 are the same as the above operations, and detailed explanation thereof is omitted.

[First Operation]

Next, a first operation of the image forming apparatus 10 is explained with reference to FIGS. 1 and 2. In the first operation, the first engine module 20 and the second engine module 30 print color images independently of each other.

The transfer belt 23 of the first engine module 20 runs at fixed speed by the drive roller 24 rotated by a motor (not shown).

First, the charging device 51*a* in the process unit 22*a* uniformly charges the photosensitive drum 21*a*. The charged photosensitive drum 21*a* is subjected to exposure by the LED array 50*a* in conformity with image information, and thereby an electrostatic latent image is formed on the photosensitive drum 21*a*.

The developer device 52*a* containing a developer (toner) of yellow (Y) is disposed downstream from the exposure by the LED array 50*a*. The electrostatic latent image on the photosensitive drum 21*a* is subjected to reverse development with the yellow toner, and a toner image is formed on the photosensitive drum 21*a*.

A transfer roller (not shown) is disposed downstream from the developer device 52*a*. A bias (+) having a polarity opposite to the charging polarity of the toner is applied to the transfer roller. As a result, the toner image on the photosensitive drum 21*a* is transferred onto the transfer belt 23, as primary transfer, by a transfer electric field formed between the photosensitive drum 21*a* and the transfer roller.

The photosensitive drums 21*b* to 21*d* and the process units 22*b* to 22*d* perform the same processes, simultaneously with the timing of formation of a toner image by the photosensitive drum 21*a* and the process unit 22*a*. As a result, toner images of magenta (M), cyan (C), and black (K) formed on the photosensitive drums 21*b*, 21*c* and 21*d*, respectively, are transferred onto the transfer belt 23, as primary transfer.

Paper being a transfer material is fed from the paper feed unit 11 into the first engine module 20 through the paper feed roller 26.

The transfer roller 25 is disposed on the upper end portion of the transfer belt 23. A bias (+) having a polarity opposite to the charging polarity of the toner is applied to the transfer roller 25. As a result, the toner images on the transfer belt 23 are transferred onto the paper by a transfer electric field formed between the transfer belt 23 and the transfer roller 25.

After the images transferred onto the paper are fixed by a fixing device (not shown), the paper is sent to the paper delivery unit 13 through the delivery roller 27 and stored therein.

Also in the second engine module 30, images are printed on paper by the same operation as that of the first engine module 20. After the images transferred onto the paper are fixed by a fixing device (not shown), the paper is sent to the paper delivery unit 13 through the delivery roller 37 and stored therein.

In the first operation, two image forming operations are performed in parallel in one image forming apparatus 10. Therefore, the printing speed is increased twice the normal speed.

[Second Operation]

In the second operation, the first engine module 20 and the second engine module 30 successively operate, and print color images on the front and back sides of a sheet of paper.

The first engine module 20 performs the same operation as the operation explained above, and a sheet of paper onto which an image has been fixed is ejected from the first engine module 20 by the delivery roller 27. However, the paper is not conveyed to the delivery unit 13, but to the second engine module 30.

In the second engine module 30, toner images are transferred as primary transfer onto the transfer belt 33 as described above. However, paper is not fed from the paper feed unit 11. The toner images on the transfer belt 33 are transferred onto the paper sent from the first engine module 20, by a transfer electric field formed between the transfer belt 33 and the transfer roller 35. Then, after the images transferred onto the paper are fixed by the fixing device (not shown), the paper is sent to the paper delivery unit 13 through the delivery roller 37 and stored therein.

In the second operation, part of two image formation operations are performed in parallel in one image forming apparatus 10, and double-sided printing is performed. Therefore, the double-sided printing speed is increased.

It is also possible to print images only on one side of paper in a superposed manner, by providing a paper reverse mechanism (not shown) on the eject side of the first engine module 20, and feeding paper to the second engine module 30 thereby.

As described above, the image forming apparatus according to the present invention has a plurality of image forming sections. Such an image forming apparatus is referred to as "multiengine image forming apparatus" hereinafter, to distinguish it from conventional apparatuses. Since the image forming sections are formed as modules, a multiengine image forming apparatus can be formed by combining a plurality of various image forming sections.

Figure 3:
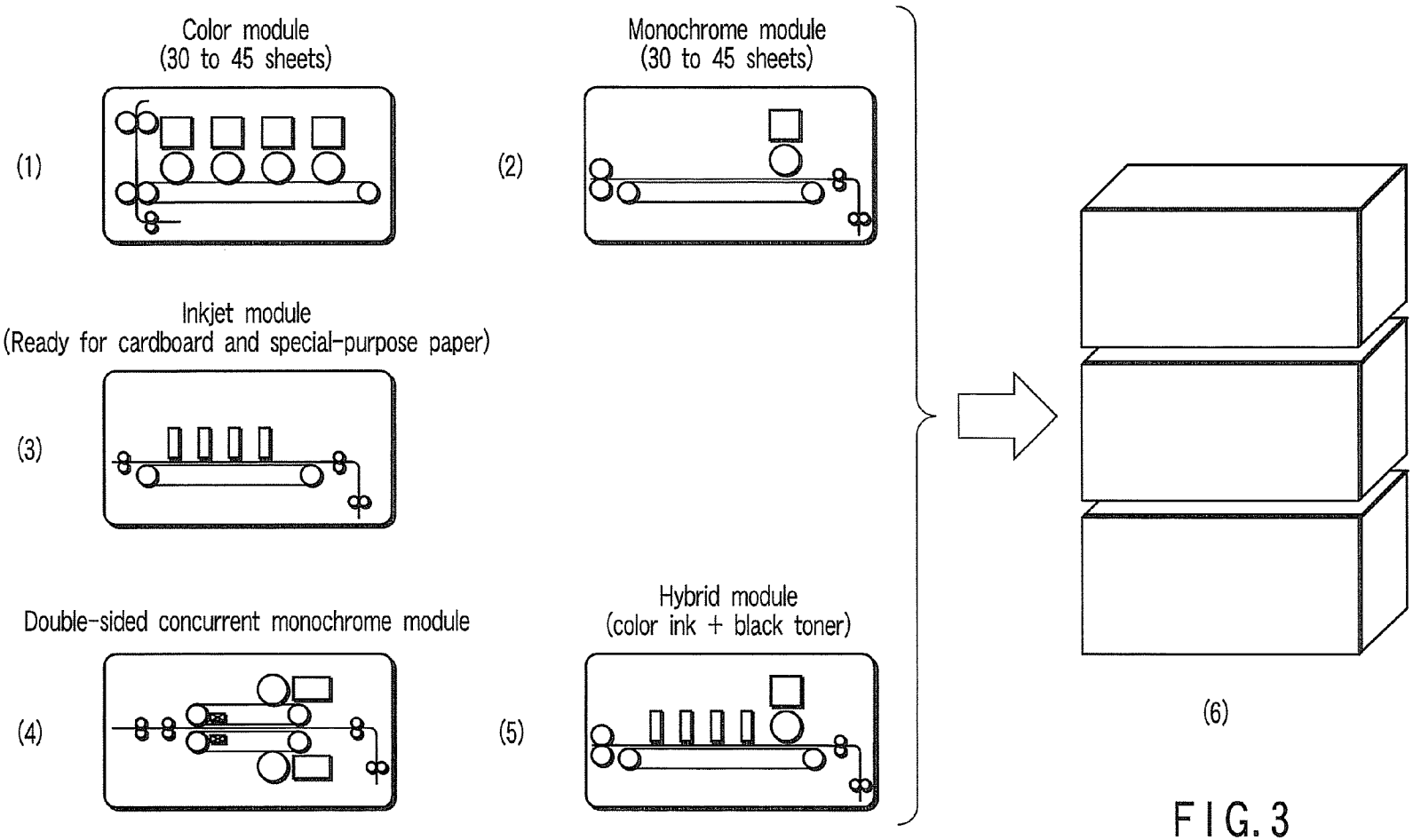
FIG. 3 is a diagram illustrating a basic concept of a multi-engine image forming apparatus.

FIG. 3 is a diagram illustrating a basic concept of a multiengine image forming apparatus. (1) to (5) of FIG. 3 illustrate structures of the image forming sections, and (6) of FIG. 3 illustrates a state where a plurality of image forming sections are used in combination.

FIG. 3 (1) illustrates a color module. The color module is an electrophotographic module which prints color images at a speed of 30 to 45 PPM (pages per minute). FIG. 3 (2) illustrates a monochrome module. The monochrome module is an electrophotographic module which prints monochrome images at a speed of 30 to 45 PPM. FIG. 3 (3) illustrates an inkjet module. The inkjet module is a module which prints color images by the inkjet system.

FIG. 3 (4) illustrates a double-sided concurrent monochrome module. The double-sided concurrent monochrome module is an electrophotographic module which prints monochrome images on both sides of paper at a speed of 30 to 45 PPM. FIG. 3 (5) illustrates a hybrid module. The hybrid module is a module which prints black color by electrophotography, and print other colors by the inkjet system.

Further, these image forming sections formed as modules can be used in combination as desired, as illustrated in FIG. 3 (6).

However, various challenges must be solved to realize the above basic concept. The first challenge is to make the size of each module more compact such that a plurality of modules are contained in one housing of the multiengine image forming apparatus. The second challenge is to avoid generating a large difference in printing speed between the modules.

Methods of solving these challenges are explained below.

(1) It is indispensable to downsize image forming sections in a multiengine image forming apparatus having a plurality of image forming sections.

In this embodiment, as illustrated in FIGS. 1 and 2, an LED array is used as exposure means instead of a conventional laser optical system.

The LED array system uses a photosensitive drum, in which a transparent member such as glass is used as a cylindrical board holding a photosensitive member, and a transparent conductive layer, an electric charge injection blocking layer, a photosensitive layer, and a protective layer is formed on the board. Further, an LED array is disposed inside the drum, and back exposure in which exposure is performed from the inside of the drum is adopted. Since the exposure means is disposed in a dead space inside the drum and flexibility in arrangement of other devices such as developer devices is increased, the size of image forming sections is greatly reduced.

Figure 4:
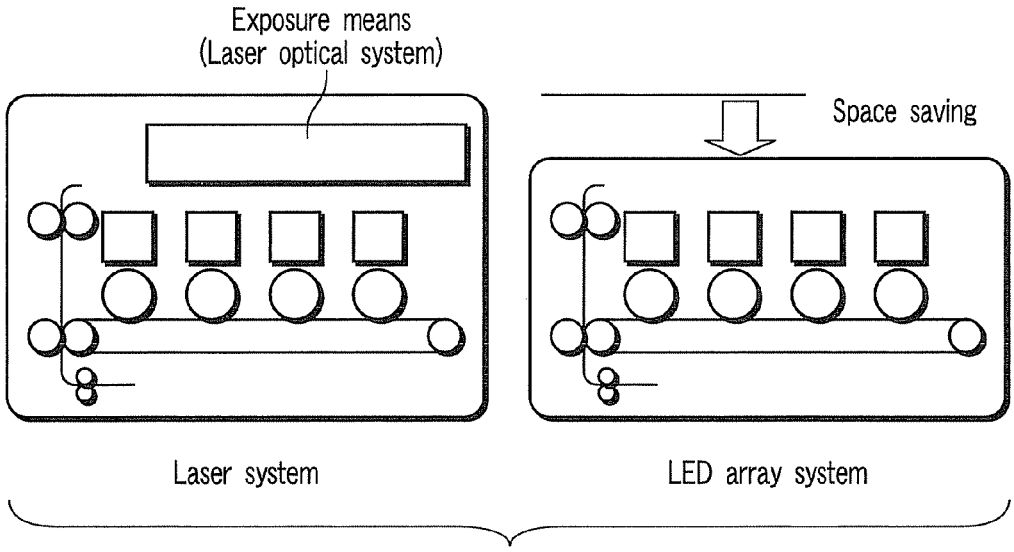
FIG. 4 is a diagram illustrating a laser system in contrast with an LED array system.

FIG. 4 is a diagram illustrating the laser system in contrast with the LED array system. Since the LED array system does not need a laser optical system which scans laser light, space saving is achieved.

Further, although LED arrays have a problem of being vulnerable to contamination such as toner and the like, this problem is solved by disposing the LED array inside the drum.

Further, if the quadruple color unit is changed to the monochrome unit in the laser optical system, it is inevitable to continue to use the 4-beam structure for color images as it is, and thus the running cost is increased. On the other hand, in the LED system, LED arrays other than that for monochrome images can be eliminated, as illustrated in FIG. 3 (1) and (2).

(2) In a multiengine image forming apparatus having a plurality of image forming sections, it is indispensable to level out the speed of the image forming sections.

In this embodiment, when the inkjet system is used for a module, it is necessary to increase the printing speed thereof.

Therefore, a line-head type inkjet system is adopted as the inkjet system. In the line-head type inkjet system, it is possible to perform high-speed drive, and perform printing at the same speed as that of electrophotography. Consequently, adopting the line-head type inkjet system enables various combinations of electrophotography and inkjet system.

FIG. 5 is a diagram illustrating configuration examples of combinations of the image forming sections. FIG. 5 illustrates functions and effects obtained in the cases where the first engine module and the second engine module are operated in parallel and in series. In the configuration examples, parallel operation indicates that the engine modules are operated individually or alone, and operation in series indicates that printing operation is performed by the first engine module and thereafter performed by the second engine module.

In Combination Case 1 of FIG. 5, the first engine module is an electrophotographic color module, and the second engine module is also an electrophotographic color module. In this combination, the printing speed is increased by operating the modules in parallel, and double-sided printing is performed at high speed by operating the modules in series.

In Combination Case 2, the first engine module is an electrophotographic color module, and the second engine module is an electrophotographic monochrome module. This combination reduces the printing cost by operating the modules individually in accordance with the type (color/monochrome) of the document.

In Combination Case 3, the first engine module is an electrophotographic monochrome module, and the second engine module is also an electrophotographic monochrome module. In this combination, the printing speed is increased by operating the modules in parallel, and double-sided printing is performed at high speed by operating the modules in series.

In Combination Case 4, the first engine module is an electrophotographic monochrome module, and the second engine module is an inkjet module. In this combination, high-definition images are printed by operating the modules in series, and reduction of costs is achieved.

In Combination Case 5, the first engine module is an inkjet module, and the second engine module is also an inkjet module. In this combination, the printing speed is increased by operating the modules in parallel, and double-sided printing is performed at high speed by operating the modules in series.

Although paper is used for image recording in the above embodiment, recording medium is not limited to paper, but recording medium such as OHP paper and fax paper can be used.

[Effects of the Embodiment]

As described above, the image forming method of the above embodiment produces various effects as follows.

Since modules can be made compact, it is possible to restructure the modules in conformity with change of customer needs.

For example, the cost in installation is reduced by using inexpensive engines of 30 to 45 sheets, and more modules are added in accordance with change of circumstances. Thereby, it is possible to achieve productivity as high as that of high-speed machines.

Further, ease of maintenance is improved by forming the image forming sections as modules, and downtime is reduced by making the system dual-redundant.

Specifically, since the image forming sections are formed as modules, failures can be dealt with by only changing the failed image forming section to new one as a rule, and thus the time necessary for maintenance is shortened. Further, since the system is made redundant, it is possible to avoid stopping the whole apparatus even when one module suffers a failure.

Specifically, the embodiment of the present invention produces the following effects.

(1) Increase in Speed: Since a plurality of image forming sections are operated in parallel, high-speed printing is achieved.

(2) Reduction in CPC (cost per copy): Since monochrome electrophotographic system and color inkjet system are operated in series, reduction in cost is achieved.

(3) Improvement in Image Quality: Since monochrome electrophotographic system and color inkjet system are operated in series, high-definition printing is achieved.

(4) High Reliability: Since a plurality of image forming sections are operated in parallel, even if one image forming section suffers a failure, other sections can output images.

(5) Upgradability: The apparatus can be upgraded as desired from a configuration having one monochrome picture system module to a configuration having n number of color picture system modules, in accordance with frequency of actual use thereof and user demands. Further, conversely, the apparatus can be downgraded as desired.

The functions explained in the above embodiment can be configured by using hardware, or may be realized by using software to read programs describing the functions into the computer. Further, the functions may be configured by selecting one of software and hardware according to necessity.

Furthermore, the functions can be realized by reading programs stored in recording media (not shown) into the computer. The recording media used in the above embodiment may adopt any recording format, as long as they are recording media which can record programs and from which the computer can read the programs.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus installed in a digital multifunction peripheral (MFP) having a copying function of recording images continuously and a function of transmitting and receiving information to and from an external apparatus, comprising:

a first storing section which stores recording media before recording;

a plurality of image forming sections which form images and record the images on the recording media; and a second storing section which stores the recording media after recording, wherein the image forming sections are configured to selectively perform an operation of recording images on the recording media by individually performing an image forming operation in parallel, and an operation of recording images on one recording medium by performing the image forming operation by turns.

2. An image forming apparatus according to claim 1, wherein at least one of the image forming sections includes:

an exposure section which emits light;

a photosensitive drum having a surface on which an image is formed by the light; and a recording section which records the image on the photosensitive drum on the recording media, and the exposure section is an LED array.

3. An image forming apparatus according to claim 2, wherein the LED array is disposed inside the photosensitive drum.

4. An image forming apparatus according to claim 2, wherein at least one of the image forming sections having a structure in which a plurality of photosensitive drums forming images of different colors are arranged in series.

5. An image forming apparatus according to claim 2, wherein one of the other image forming sections is configured to have an inkjet system using a line head.

6. An image forming apparatus according to claim 2, wherein each of the image forming sections is formed as an module.

7. An image forming apparatus according to claim 6, wherein at least one of the image forming sections and at least another one of the image forming sections are electrophotographic modules which form color images.

8. An image forming apparatus according to claim 6, wherein at least one of the image forming sections is an electrophotographic module which forms color images, and at least another one of the image forming sections is an electrophotographic module which forms monochrome images.

9. An image forming apparatus according to claim 6, wherein at least one of the image forming sections and at least another one of the image forming sections are electrophotographic modules which form monochrome images.

10. An image forming apparatus according to claim 6, wherein at least one of the image forming sections is an electrophotographic module which forms monochrome images, and at least another one of the image forming sections is an inkjet module which forms color images.

11. An image forming apparatus according to claim 6, wherein at least one of the image forming sections and at least another one of the image forming sections are inkjet modules which form color images.

12. An image forming method of an image forming apparatus installed in a digital multifunction peripheral (MFP) having a copying function of recording images continuously and a function of transmitting and receiving information to and from an external apparatus, comprising:

storing recording media before recording;

selectively controlling a plurality of image forming sections which form images and record the images on the recording media, and causing the image forming sections to perform an operation of recording images on the recording media by individually performing an image forming operation in parallel, and an operation of recording images on one recording medium by performing the image forming operation by turns; and storing the recording media after recording.

13. An image forming method according to claim 12, wherein operation of at least one of the image forming sections includes:

emitting light from an LED array;

forming an image on a surface of a photosensitive drum by the light; and recording the image on the photosensitive drum on the recording media.

14. An image forming method according to claim 13, wherein the LED array is disposed inside the photosensitive drum.

15. An image forming method according to claim 13, wherein one of the other image forming sections is configured to have an inkjet system using a line head.

16. An image forming method according to claim 13, wherein each of the image forming sections is formed as an module.

17. An image forming method according to claim 16, wherein at least one of the image forming sections and at least another one of the image forming sections are electrophotographic modules which form color images.

18. An image forming method according to claim 16, wherein at least one of the image forming sections is an electrophotographic module which forms color images, and at least another one of the image forming sections is an electrophotographic module which forms monochrome images.

19. An image forming method according to claim 16, wherein at least one of the image forming sections and at least another one of the image forming sections are electrophotographic modules which form monochrome images.

20. An image forming method according to claim 16, wherein at least one of the image forming sections is an electrophotographic module which forms monochrome images, and at least another one of the image forming sections is an inkjet module which forms color images.

* * * * *